US012016402B2

(12) United States Patent
Morgan

(10) Patent No.: US 12,016,402 B2
(45) Date of Patent: Jun. 25, 2024

(54) BRA SUPPORT STRUCTURE

(71) Applicant: NIKE, Inc., Beaverton, OR (US)

(72) Inventor: Daniel P. Morgan, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 69 days.

(21) Appl. No.: 17/703,208

(22) Filed: Mar. 24, 2022

(65) Prior Publication Data

US 2022/0361594 A1 Nov. 17, 2022

Related U.S. Application Data

(60) Provisional application No. 63/189,441, filed on May 17, 2021.

(51) Int. Cl.
*A41C 3/00* (2006.01)
*A41C 3/12* (2006.01)

(52) U.S. Cl.
CPC ..... *A41C 3/0021* (2013.01); *A41C 3/12* (2013.01)

(58) Field of Classification Search
CPC ..... A41C 3/0021; A41C 3/12
USPC ..... 450/57
See application file for complete search history.

(56) References Cited

U.S. PATENT DOCUMENTS 2,469,654 A 5/1949 Gerda
2,484,440 A 10/1949 Max
2,983,274 A 5/1961 Plehn
3,411,508 A * 11/1968 Sayers ..... A41C 3/0078 450/86
4,254,777 A 3/1981 Johnston
D301,932 S 7/1989 Guss
D321,083 S * 10/1991 Thygesen ..... D2/706
6,896,581 B2 * 5/2005 Otto ..... A41C 5/00 450/59
7,089,597 B2 8/2006 Horii et al.
7,267,599 B2 9/2007 Allen et al.
D584,879 S 1/2009 Venus
7,833,082 B2 11/2010 Bugada
D671,297 S 11/2012 Iamartino
8,549,763 B2 10/2013 Krawchuk
9,516,905 B2 12/2016 Pagnon
9,750,288 B2 * 9/2017 Gehlhausen ..... A41C 1/06
(Continued)

FOREIGN PATENT DOCUMENTS

KR 20-0387854 Y1 6/2005
WO 2014/207379 A1 12/2014
(Continued)

OTHER PUBLICATIONS

International Search Report and Written Opinion received for PCT Patent Application No. PCT/US2022/022454, dated Aug. 5, 2022, 12 pages.

(Continued)

*Primary Examiner* — Gloria M Hale
(74) *Attorney, Agent, or Firm* — SHOOK, HARDY & BACON L.L.P.

(57) ABSTRACT

Aspects herein are directed to a support structure for a breast-covering portion of a support garment. The support structure includes a plurality of discrete cable structures. At least a portion of the discrete cable structures have a first shape configuration in an un-tensioned state and a second shape configuration in a tensioned state.

19 Claims, 5 Drawing Sheets

(56) References Cited

U.S. PATENT DOCUMENTS

| | | | | |
|---|---|---|---|---|
| D816,942 | S | 5/2018 | Holmes | |
| 10,368,591 | B2 | 8/2019 | Funk-Danielson et al. | |
| 10,448,679 | B1 | 10/2019 | Roddis et al. | |
| 10,609,966 | B2 | 4/2020 | Huffa et al. | |
| 2005/0060792 | A1 | 3/2005 | Desai | |
| 2015/0087204 | A1 | 3/2015 | Conde | |
| 2016/0360801 | A1 | 12/2016 | Sze et al. | |
| 2019/0045853 | A1* | 2/2019 | Mizoguchi | A41C 3/0021 |
| 2019/0116891 | A1* | 4/2019 | Wisniewski | A41C 3/0092 |
| 2020/0323279 | A1* | 10/2020 | Castillo Piedra | A41C 3/0057 |
| 2020/0375269 | A1 | 12/2020 | Andon et al. | |
| 2022/0304394 | A1* | 9/2022 | Castillo Piedra | A41C 3/0021 |

FOREIGN PATENT DOCUMENTS

| | | | |
|---|---|---|---|
| WO | 2016/059578 | A1 | 4/2016 |
| WO | 2016/135673 | A1 | 9/2016 |
| WO | 2019/169276 | A1 | 9/2019 |

OTHER PUBLICATIONS

"Mesh Sports Bra", Sadoun, Available online at: <https://www.sadoun.com/product/mesh-sports-bra-hollow-out-sport-top-seamless-fitness-yoga-bras-women-gym-top-padded-running-vest-shockproof-push-up-crop-top/>, Sep. 26, 2020, 12 pages.

Ocamo Elastic Rope Bra Straps, Amazon, Available online at: <https://www.amazon.in/Ocamo-Elastic-Artemis-Harness-Bondage/dp/B07H93JSQL>, Sep. 12, 2018, 4 pages.

International Search Report and Written Opinion received for PCT Patent Application No. PCT/US2022/041359, dated Nov. 28, 2022, 12 pages.

Office Action received for European Application No. 22718395.1, mailed on Jan. 3, 2024, 3 pages.

* cited by examiner

BRA SUPPORT STRUCTURE

CROSS-REFERENCE TO RELATED APPLICATIONS

This application, titled "Bra Support Structure," claims the benefit of priority of U.S. App. No. 63/189,441, filed May 17, 2021, and titled "Bra Support Structure." The entirety of the aforementioned application is incorporated by reference herein.

TECHNICAL FIELD

Aspects herein relate to a support structure for a breast-covering portion of a bra that includes a plurality of discrete cable structures.

BACKGROUND

Traditional support garments in the form of bras provide support by using one or more panels of textile materials having varying degrees of stretch and recovery in different areas of the bra or by layering different materials on top of each other to create the needed support. Moreover, the different materials are often molded to form a "cup" shape. These types of bras may be time-consuming and expensive to manufacture as well as provide only limited customizability of fit and/or support to the wearer.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A breast-covering portion of a support garment, the breast-covering portion comprising: a base layer; and a support structure positioned external to the base layer and including a first plurality of discrete cable structures, each discrete cable structure of the first plurality of discrete cable structures having a first shape configuration in an un-tensioned state and a second shape configuration in a tensioned state.

Clause 2. The breast-covering portion according to clause 1, wherein the support structure is affixed to the base layer at a first location and a second location and unaffixed from the base layer between the first location and the second location.

Clause 3. The breast-covering portion according to clause 2, wherein the first location is at an upper aspect of the breast-covering portion and the second location is at a lower aspect of the breast-covering portion.

Clause 4. The breast-covering portion according to any of clauses 2 through 3, wherein the first plurality of discrete cable structures extends between the first location and the second location over at least a central region of the breast-covering portion.

Clause 5. The breast-covering portion according to any of clauses 2 through 4, wherein the first plurality of discrete cable structures is not affixed to the base layer between the first location and the second location.

Clause 6. The breast-covering portion according to any of clauses 1 through 5, wherein the support structure has a greater resistance to stretch than the base layer.

Clause 7. The breast-covering portion according to any of clauses 1 through 6, wherein when each discrete cable structure is in the first shape configuration, each discrete cable structure includes a plurality of linear segments alternately extending in a positive x-direction and a negative x-direction.

Clause 8. The breast-covering portion according to any of clauses 1 through 7, wherein when each discrete cable structure is in the second shape configuration, each discrete cable structure includes a single continuous linear segment.

Clause 9. A breast-covering portion of a support garment, the breast-covering portion comprising: a support structure including: a first plurality of discrete cable structures, each discrete cable structure of the first plurality of discrete cable structures having a first shape configuration in an un-tensioned state and a second shape configuration in a tensioned state, the second shape configuration different from the first shape configuration, and a second plurality of discrete cable structures, each discrete cable structure of the second plurality of discrete cable structures having the second shape configuration in the un-tensioned state and the tensioned state.

Clause 10. The breast-covering portion of the support garment according to clause 9, wherein the first plurality of discrete cable structures extends from an upper aspect of the breast-covering portion, over a central region of the breast-covering portion, and to a lower aspect of the breast-covering portion.

Clause 11. The breast-covering portion of the support garment according to any of clauses 9 through 10, wherein the second plurality of discrete cable structures extends from the upper aspect of the breast-covering portion, over a lateral region and a medial region of the breast-covering portion, and to the lower aspect of the breast-covering portion.

Clause 12. The breast-covering portion of the support garment according to any of clauses 9 through 11, wherein the support structure further comprises an underband portion positioned at the lower aspect of the breast-covering portion, and wherein each of the first plurality of discrete cable structures and the second plurality of discrete cable structures extends from the underband portion.

Clause 13. The breast-covering portion of the support garment according to any of clauses 9 through 12, wherein the first shape configuration includes a plurality of linear segments alternately extending in a positive x-direction and a negative x-direction.

Clause 14. The breast-covering portion of the support garment according to any of clauses 9 through 13, wherein the second shape configuration includes a single continuous linear segment.

Clause 15. A method of manufacturing a support structure for a breast-covering portion of a support garment, the method comprising: forming the support structure in a flat, planar form, the support structure including: a first plurality of discrete cable structures, each discrete cable structure of the first plurality of discrete cable structures having a first shape configuration, and a second plurality of discrete cable structures, each discrete cable structure of the second plurality of discrete cable structures having a second shape configuration different from the first shape configuration.

Clause 16. The method of manufacturing the support structure for the breast-covering portion of the support garment according to clause 15, wherein the first shape configuration includes a plurality of linear segments alternately extending in a positive x-direction and a negative x-direction.

Clause 17. The method of manufacturing the support structure for the breast-covering portion of the support garment according to any of clauses 15 through 16, wherein the second shape configuration includes a single continuous linear segment.

Clause 18. The method of manufacturing the support structure for the breast-covering portion of the support garment according to any of clauses 15 through 17, wherein the first plurality of discrete cable structures extends from an upper aspect of the breast-covering portion, over a central region of the breast-covering portion, and to a lower aspect of the breast-covering portion.

Clause 19. The method of manufacturing the support structure for the breast-covering portion of the support garment according to any of clauses 15 through 18, wherein the second plurality of discrete cable structures extends from the upper aspect of the breast-covering portion, over a lateral region and a medial region of the breast-covering portion, and to the lower aspect of the breast-covering portion.

Clause 20. The method of manufacturing the support structure for the breast-covering portion of the support garment according to any of clauses 15 through 19, wherein the support structure is formed from a low-stretch material.

BRIEF DESCRIPTION OF THE DRAWINGS

Examples of aspects herein are described in detail below with reference to the attached drawing figures, wherein.

DETAILED DESCRIPTION

Figure 1:
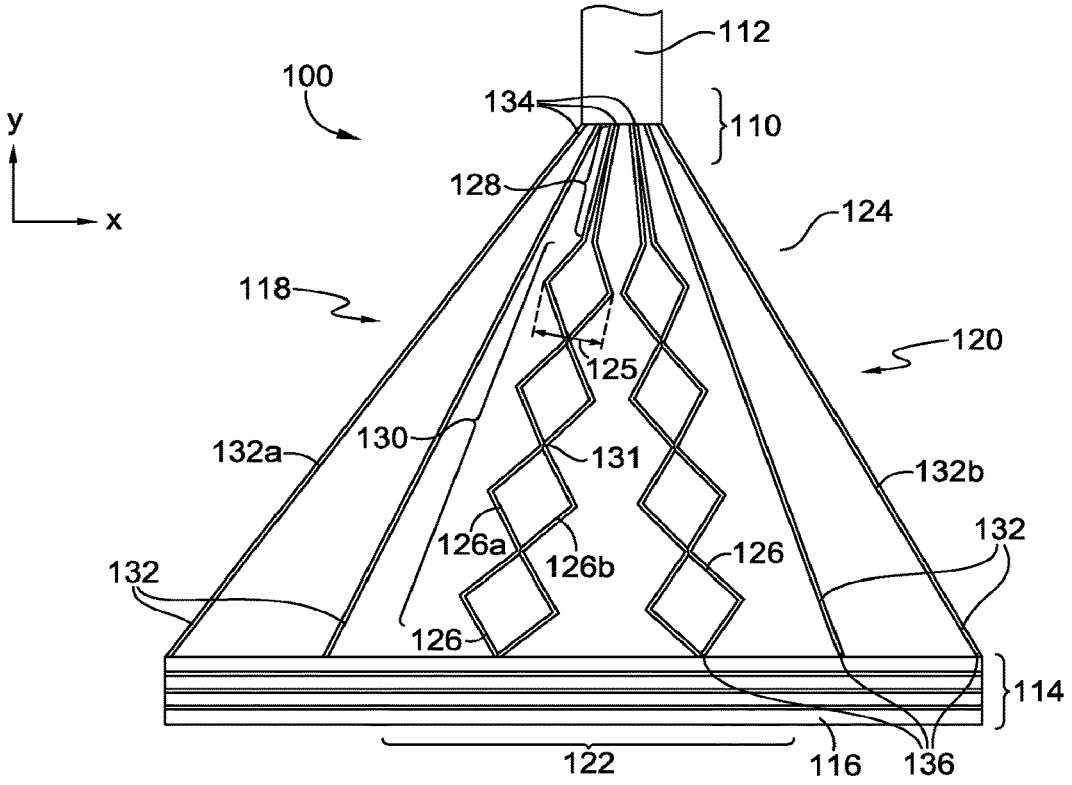
FIG. 1 illustrates a view of a first example support structure forming a breast-covering portion of a support garment, where the first example support structure is in a flat form and is in an un-tensioned state in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional support garments in the form of bras provide support by using one or more panels of textile materials having varying degrees of stretch and recovery in different areas of the bra or by layering different materials on top of each other to create the needed support. Moreover, the different materials are often molded to form a "cup" shape. These types of bras may be time-consuming and expensive to manufacture as well as provide only limited customizability of fit and/or support to the wearer.

Aspects herein are directed to a support structure for a bra that includes discrete cable structures that extend in a generally vertical orientation from an upper aspect of a breast-covering portion of the bra to a lower aspect of the breast-covering portion. The discrete cable structures are formed of a low- or no-stretch material. In example aspects, the discrete cable structures include a first plurality of discrete cable structures that extend over a central region of the breast-covering portion and a second plurality of discrete cable structures that extend over lateral and medial regions of the breast-covering portion. The first plurality of discrete cable structures have a first shape configuration in an un-tensioned state and a second shape configuration in a tensioned state. The un-tensioned state corresponds to when the bra is in an un-worn configuration (i.e., when a breast is not positioned within the breast-covering portion) and is generally in a flat, planar form, and the tensioned state corresponds to when the bra is in a worn configuration (i.e., when a breast sized to fill the breast-covering portion is positioned within the breast-covering portion). In example aspects, the first shape configuration includes a zig-zag configuration with linear segments alternately extending in positive x and negative x-directions (i.e., in medial and lateral directions), and the second shape configuration includes a single, continuous linear configuration. Use of a zig-zag configuration, or other similar configurations, facilitates a reversible increase in length when the first plurality of discrete cable structures are subject to tensioning forces and pulled taut (e.g., straight) such as when a breast is positioned within the breast-covering portion. In example aspects, the second plurality of discrete cable structures have the second shape configuration in both the un-tensioned state and the tensioned state.

When the bra is donned, the displacement caused by at least the central portion of the wearer's breast (the portion of the wearer's breast that includes the areola and areas above, below, and to the medial and lateral sides of the areola) causes the first plurality of discrete cable structures to transition from the first zig-zag shape configuration to the second linear shape configuration. Because the cable structures are formed from a low- or no-stretch material, once the cable structures are pulled taut and transition to the second shape configuration, they provide support to the central portion of the wearer's breast which may help reduce up-and-down movement of the breast when, for instance, exercising. Because there is less breast volume at the lateral and medial sides of the breast, there is generally not a need for the cable structures located in this area to undergo a reversible increase in length, thus accounting for the linear configuration of the second plurality of discrete cable structures in both the un-tensioned and the tensioned state. The second plurality of discrete cable structures provides support to the medial and lateral sides of the breast, which may help reduce medial-to-lateral sway when, for example, exercising.

In example aspects, to assist with supporting the load imposed by the wearer's breast when the bra is donned, the plurality of discrete cable structures may be anchored at the upper aspect of the breast-covering portion and at the lower aspect of the breast-covering portion. In one example, both the first and second pluralities of discrete cable structures may be anchored to a shoulder strap or a shoulder strap area of the bra by stitching, bonding, adhesives, and the like. Similarly, both the first and second pluralities of discrete cable structures may be anchored to an underband portion of the bra or a lower margin of the bra.

In example aspects, the support structure described herein may be manufactured in a flat, planar form eliminating the need for time-consuming and potentially expensive molding steps. For example, at least the first and second pluralities of discrete cable structures may be cut from a low- or no-stretch material, or the first and second pluralities of discrete cable structures may be printed in a flat form using, for example, a polymeric material such as a thermoplastic polyurethane (TPU) material. In another example, the first and second pluralities of discrete cable structures may be constructed using a flexible, yet strong material such as threads or yarns made of para-aramid fibers.

In example aspects, the geometry of at least the first plurality of discrete cable structures may be adjusted to account for different breast sizes. For bras designed for larger breasts, the length of the zig-zag segments may be increased in one or both of the positive x and negative x-directions to increase the overall length of the cable structures when the cable structures are pulled taut. As well, the number of zig-zag segments within a cable structure may be increased to cause an increase in the total length of the cable structure when pulled taut. Aspects herein further contemplate that the support structure may be customized for an individual wearer. For example, a body scan may be made of the wearer's breast and the geometry of the cable structures (i.e., the number and/or shape of the zig-zags) may be engineered such that when the bra is donned, the first plurality of discrete cable structures are collectively pulled taut. Aspects herein also contemplate using a base layer positioned under or internal to the support structure so as to be in contact or near contact with the wearer's skin surface.

As used throughout this disclosure, the term "bra" is meant to encompass any type of support garment configured to support a wearer's breasts. As such, the term bra encompasses traditional bras, sport bras, tanks, camisoles, swim tops, and the like. The term "breast-covering portion" is that portion of the bra that is positioned adjacent to a wearer's breast and generally extends from a top part (e.g., near the wearer's clavicle) to a lower part (e.g., the wearer's inframammary fold) of the wearer's breast and from a medial edge (e.g., near the wearer's sternum) to a lateral edge (e.g., near the wearer's axilla) of the wearer's breast. Positional terms when used to describe the bra and/or the breast-covering portion such as "medial," "lateral," "upper," "lower," and the like are with respect to the bra being worn as intended by a wearer standing upright. As such, the term upper means located closer to a head of a wearer, and the term lower means located closer to the waist of a wearer. The term medial when used in relation to a breast-covering portion means located closer to a midline of a wearer's body, and the term lateral when used in relation to the breast-covering portion means located closer to a mid-axillary line of the wearer. The term "central region" when used in relation to the breast-covering portion means located approximately midway between the medial and the lateral sides of the breast-covering portion. This location corresponds generally to the central vertical part of the wearer's breast which encompasses the areola and the areas of the breast above the areola up to near the wearer's clavicle, below the areola down to near or including the inframammary fold, and areas positioned to the medial and lateral sides of the areola (e.g., within about 2 to 4 cm of the areola).

The term "cable structure," means a structure having a length and a width where the length is greater than the width. For example, the length may be at least about 25 times greater than the width. For example, if an individual cable structure has a width of 5 mm, it has a length of at least about 125 mm or 12.5 cm. The term "discrete" when used to describe an individual cable structure means that the cable structure is spaced apart from adjacent cable structures at least at a midpoint of the cable structure's length. In example aspects, a discrete cable structure may include two cable structures that are joined together at one more points along their respective lengths. As described herein, the discrete cable structures are formed from a low- or no-stretch material meaning that the material generally does not have inherent stretch properties (mechanical or elastic) in response to a tensioning force and thus the length and/or width of the material remains substantially unchanged when subject to the tensioning forces below the material's breaking/tearing point. For example, the discrete cable structures may undergo a change of length from about 0% of resting length to about 20% of resting length in response to a tensioning force. One example testing standard for determining the tensile properties of yarns includes ASTM D2256/D2256M (2015). The term "zig-zag" used when describing the cable structures means a shape having alternating linear segments that extend in positive and negative x-directions along at least a portion of the length of the cable structure where the cable structure extends in a y-direction. It is contemplated herein that a particular cable structure may have linear segments that extend in a y-direction in addition to zig-zag segments. The term "linear" used when describing the shape of the cable structure means extending along a straight or nearly straight line.

Unless indicated otherwise, all measurements provided herein are taken when the support structure and/or breast-covering portion is at standard ambient temperature and pressure (298.15 K and 100 kPa).

FIG. 1 illustrates a breast-covering portion 100 of a support garment such as a bra, where the breast-covering portion 100 is configured for a left breast of a wearer in example aspects. A description of a breast-covering portion configured for a right breast of a wearer would be generally the same. The breast-covering portion 100 is shown in a flat, planar form such as would occur post-manufacturing. The breast-covering portion 100 includes, in example aspects, an upper aspect, referenced generally by the numeral 110, which may, in some aspects, include a portion of a shoulder strap 112. The breast-covering portion 100 further includes a lower aspect, referenced generally by the numeral 114, which may, in some aspects, include an underband 116. The breast-covering portion 100 includes a medial side or region 118 and a lateral side or region 120. A central region 122 is positioned between the medial region 118 and the lateral region 120.

The breast-covering portion 100 includes a support structure, referenced generally by the numeral 124. In example aspects, the support structure 124 may be formed of a low- or no-stretch material such as TPU, a tightly woven textile that does not include elastic yarns, a tightly knit textile that does not include elastic yarns, nonwoven materials, threads or yarns formed from para-aramid fibers, combinations of the above, and the like. As described further below, the support structure 124 may be manufactured in a flat, planar form using various methods such as, for example, printing (e.g., extruding a liquid TPU from a printer head in a predefined pattern), cutting a textile material, braiding, embroidering, and the like.

The support structure 124 includes a first plurality of discrete cable structures 126 having a first shape configuration when the breast-covering portion 100 is in the flat, planar form and is in an un-tensioned state. The first plurality of discrete cable structures 126 extend generally vertically from the upper aspect 110 of the breast-covering portion 100, over the central region 122, and to the lower aspect 114 of the breast-covering portion 100. In the configuration shown in FIG. 1, each of the first plurality of discrete cable structures 126 includes a first cable structure 126*a* and a second cable structure 126*b* that together form one of the discrete cable structures 126. When the breast-covering portion 100 is in the flat, planar form as shown in FIG. 1, which corresponds to when the breast-covering portion 100 is in an un-tensioned state, each of the first cable structure 126*a* and the second cable structure 126*b* includes a generally vertical linear segment 128 and a zig-zag segment 130. In the zig-zag segment 130, each of the first cable structure 126*a* and the second cable structure 126*b* alternately extend in the positive and negative x-directions with reference to the Cartesian coordinate system shown in FIG. 1. As shown in FIG. 1, the amount of extension or displacement 125 in the positive and negative x-directions is measured from a midline of the cable structure 126 which comprises a hypothetical extension of the linear segment 128. In example aspects herein, the zig-zag segment 130 is in the first shape configuration. Each of the first cable structure 126*a* and the second cable structure 126*b* may be joined at areas where their respective zig-zag shapes intersect such as at point 131. The use of zig-zags, and other similar shapes having alternating segments extending in the positive and negative x-directions, increases the total length of each of the first plurality of discrete cable structures 126 when pulled taut.

The number of zig-zags in the zig-zag segment 130 may be increased or decreased to account for different breast sizes. For instance, increasing the number of zig-zags in the zig-zag segment 130 increases the overall length of the first plurality of discrete cable structures 126 when pulled taut and may be used when the support structure 124 is sized for larger breasts. Conversely, decreasing the number of zig-zags in the zig-zag segment 130 relatively reduces the overall length of the first plurality of discrete cable structures 126 when pulled taut and may be used when the support structure 124 is sized for smaller breasts. In another example, the amount of displacement 125 of the zig-zags in the positive and negative x-directions may be increased or decreased to account for different breast sizes. For example, increasing the amount of displacement 125 of the zig-zags in the positive and/or negative x-directions increases the overall length of the first plurality of discrete cable structures 126 when pulled taut and may be used when the support structure 124 is sized for larger breasts. Conversely, decreasing the displacement 125 of the zig-zags in the positive and/or negative x-direction relatively reduces the overall length of the first plurality of discrete cable structures 126 when pulled taut and may be used when the support structure 124 is sized for smaller breasts. It is further contemplated herein that both the number of zig-zags in the zig-zag segment 130 and the amount of displacement 125 of the zig-zags in the positive and negative x-directions may be adjusted to either increase the overall length of the first plurality of discrete cable structures 126 or decrease the overall length of the first plurality of discrete cable structures 126 when pulled taut.

The first shape configuration shown in FIG. 1 is illustrative. For example, it is contemplated herein that the first plurality of discrete cable structures 126 may not include the linear segment 128, or the linear segment 128 may be shorter or longer than that shown. It is also contemplated herein that the zig-zag segment 130 may assume other shapes that alternately extend in the positive and negative x-directions to increase the overall length of the discrete cable structures 126 when pulled taut. Example shapes include, for instance, curves or waves (e.g., sine curves).

The support structure 124 further includes a second plurality of discrete cable structures 132 including a medial set 132*a* positioned at the medial region 118 of the breast-covering portion 100 and a lateral set 132*b* positioned at the lateral region 120 of the breast-covering portion 100. The medial set of the discrete cable structures 132*a* has a second shape configuration and extends linearly in a generally vertical orientation from the upper aspect 110 of the breast-covering portion 100, along the medial region 118 of the breast-covering portion 100, and to the lower aspect 114 of the breast-covering portion 100. The lateral set of discrete cable structures 132*b* also has the second shape configuration and extends linearly in a vertical orientation from the upper aspect 110 of the breast-covering portion 100, along the lateral region 120 of the breast-covering portion 100, and to the lower aspect 114 of the breast-covering portion 100. In example aspects, the second shape configuration includes a single, continuous linear segment without any zig-zags or other similar shapes. As such, because the second plurality of discrete cable structures 132 are formed of a low- or no-stretch material, the second plurality of discrete cable structures 132 have a relatively fixed length whether in an un-tensioned state or a tensioned state. Vertically orienting both the first plurality of discrete cable structures 126 and the second plurality of discrete cable structures 132 aligns the cable structures 126 and 132 with the gravitational force experienced by a wearer's breasts when standing upright.

Each of the first plurality of discrete cable structures 126 and the second plurality of discrete cable structures 132 have first ends 134 that are anchored at the upper aspect 110 and second ends 136 that are anchored at the lower aspect 114 of the breast-covering portion 100. In one example aspect, the first ends 134 may be anchored by stitching, bonding, melting, welding, and the like the first ends 134 to the shoulder strap 112 or areas immediately adjacent the shoulder strap 112 and the second ends 136 to the underband 116. In another example aspect, the shoulder strap 112 and/or the underband 116 may be integrally formed with the first plurality of discrete cable structures 126 and the second plurality of discrete cable structures 132 such that the first ends 134 integrally extend from the shoulder strap 112, and the second ends 136 integrally extend from the underband 116. Fixedly anchoring the first ends 134 and the second ends 136 facilitates the first plurality of discrete cable structures 126 and the second plurality of discrete cable structures 132 supporting the vertical load imposed by a breast when positioned within the breast-covering portion 100.

The spacing between each of the first plurality of discrete cable structures 126 and the second plurality of discrete cable structures 132 shown in FIG. 1 is illustrative. In example aspects, the spacing between the cable structures 126 and 132 as well as the number of cable structures 126 and 132 may be adjusted to provide more or less support. For example, increased support over the central region 122 of the breast-covering portion 100 may be achieved by increasing the number of cable structures in the first plurality of discrete cable structures 126 and/or decreasing the spacing between each of the cable structures 126, while less support over the central region 122 may be achieved by decreasing the number of cable structures in the first plurality of discrete cable structures 126 and/or increasing the spacing between each of the cable structures 126. Increased support over the medial region 118 and/or the lateral region 120 of the breast-covering portion 100 may be achieved by increasing the number of cable structures in the second plurality of discrete cable structures 132 and/or decreasing the spacing between each of the cable structures 132, while less support over the medial region 118 and/or the lateral region 120 may be achieved by decreasing the number of cable structures in the second plurality of discrete cable structures 132 and/or increasing the spacing between each of the cable structures 132. As well, additional pluralities of cable structures may be included to increase the overall support provided by the support structure 124. For instance, the support structure 124 may include a third plurality of discrete cable structures, a fourth plurality of discrete cable structures, and so on.

Figure 2:
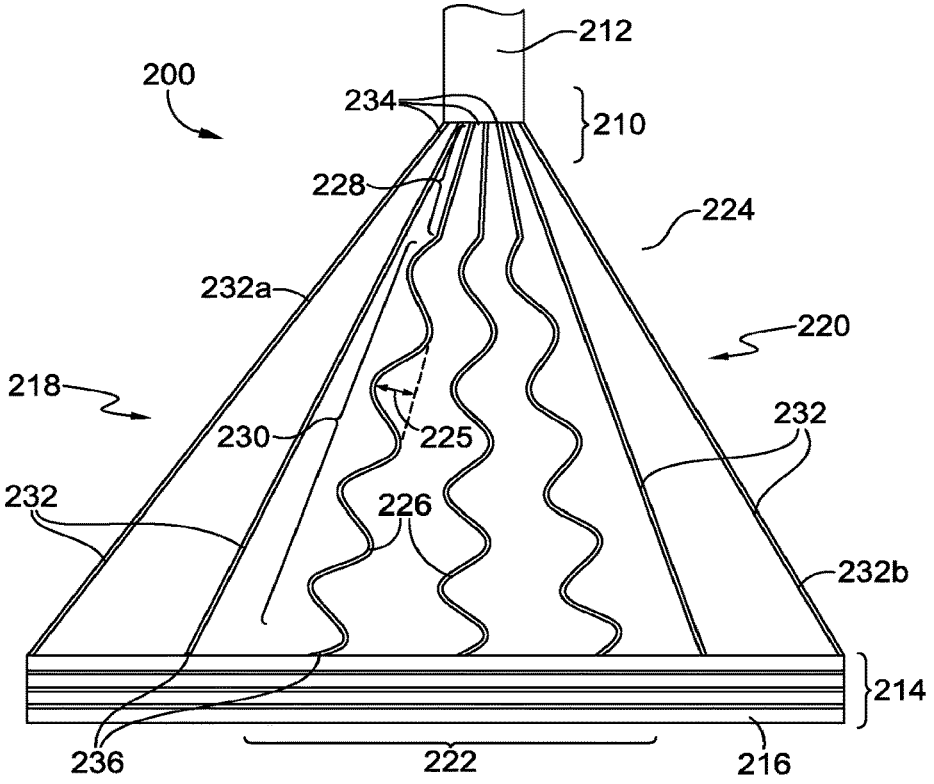
FIG. 2 illustrates a view of a second example support structure forming a breast-covering portion of a support garment, where the second example support structure is in a flat form and is in an un-tensioned state in accordance with aspects herein.

FIG. 2 depicts a second example breast-covering portion 200. Similar to the breast-covering portion 100, the breast-covering portion 200 is configured for a left breast of a wearer. A depiction of a breast-covering portion configured for a right breast of a wearer would be generally the same. The breast-covering portion 200 is shown in a flat, planar form such as would occur post-manufacturing. The breast-covering portion 200 includes, in example aspects, an upper aspect 210, which may in some aspects include a portion of a shoulder strap 212. The breast-covering portion 200 further includes a lower aspect 214, which may, in some aspects, include an underband 216. The breast-covering portion 200 includes a medial region 218 and a lateral region 220. A central region 222 is positioned between the medial region 218 and the lateral region 220.

The breast-covering portion 200 includes a support structure 224. Similar to the support structure 124, the support structure 224 may be formed of a low- or a no-stretch material. The support structure 224 is manufactured in a flat, planar form using example manufacturing methods described above for the support structure 124.

The support structure 224 includes a first plurality of discrete cable structures 226 having a first shape configuration when the breast-covering portion 200 is in the flat, planar form and is in an un-tensioned state. The first plurality of discrete cable structures 226 extends generally vertically from the upper aspect 210 of the breast-covering portion 200, over the central region 222, and to the lower aspect 214 of the breast-covering portion 200. In the example shown in FIG. 2, each of the first plurality of discrete cable structures 226 includes a single cable structure. When the breast-covering portion 200 is in the flat, planar form, each of the first plurality of discrete cable structures 226 includes a linear segment 228 and wave segment 230. In the wave segment 230, each of the first plurality of discrete cable structures 226 alternately extends in the positive and negative x-directions similar to a sine wave. In example aspects, the wave segment 230 comprises the first shape configuration. Similar to the zig-zag segment 130 of the breast-covering portion 100, the use of waves increases the overall length of each of the first plurality of discrete cable structures 226 when pulled taut. Further similar to the zig-zag segment 130, the number and/or amplitude 225 of the waves in the wave segment 230 may be increased to increase the overall length of the first plurality of discrete cable structures 226 when pulled taut, or the number and/or amplitude 225 of the waves may be decreased to decrease the overall length of the first plurality of discrete cable structures 226 when pulled taut. As shown in FIG. 2, the amplitude 225 is measured from a midline of the cable structure 226 that comprises a hypothetical extension of the linear segment 228.

The first shape configuration shown in FIG. 2 is illustrative. For example, it is contemplated herein that the first plurality of discrete cable structures 226 may not include the linear segment 228, or the linear segment 228 may be shorter or longer than that shown. It is also contemplated herein that the wave segment 230 may assume other shapes that increase the overall length of the discrete cable structures 226 when pulled taut.

The support structure 224 further includes a second plurality of discrete cable structures 232 including a medial set **232*a* positioned at the medial region 218 of the breast-covering portion 200 and a lateral set 232*b* positioned at the lateral region 220 of the breast-covering portion 200. The medial set of the discrete cable structures 232*a* has a second shape configuration and extends generally vertically from the upper aspect 210 of the breast-covering portion 200, along the medial region 218 of the breast-covering portion 200, and to the lower aspect 214 of the breast-covering portion 200. The lateral set of discrete cable structures 232*b* also has the second shape configuration and extends generally vertically from the upper aspect 210 of the breast-covering portion 200, along the lateral region 220 of the breast-covering portion 200, and to the lower aspect 214 of the breast-covering portion 200. In example aspects, the second shape configuration includes a single, continuous linear segment without any waves or other similar shapes. As such, because the second plurality of discrete cable structures 232 is formed of a low- or no-stretch material, the second plurality of discrete cable structures 232** has a relatively fixed length whether in an un-tensioned state or a tensioned state.

Each of the first plurality of discrete cable structures 226 and the second plurality of discrete cable structures 232 have first ends 234 that are anchored at the upper aspect 210 and second ends 236 that are anchored at the lower aspect 214 of the breast-covering portion 200. In one example aspect, the first ends 234 may be anchored by stitching, bonding, melting, welding, and the like the first ends 234 to the shoulder strap 212 or areas immediately adjacent the shoulder strap 212 and the second ends 236 to the underband 216. In another example aspect, the shoulder strap 212 and/or the underband 216 may be integrally formed with the first plurality of discrete cable structures 226 and the second plurality of discrete cable structures 232 such that the first ends 234 integrally extend from the shoulder strap 212, and the second ends 236 integrally extend from the underband 216.

Similar to the support structure 124, the spacing between the cable structures 226 and 232 as well as the number of cable structures 226 and 232 may be adjusted to provide more or less support.

Figure 3:
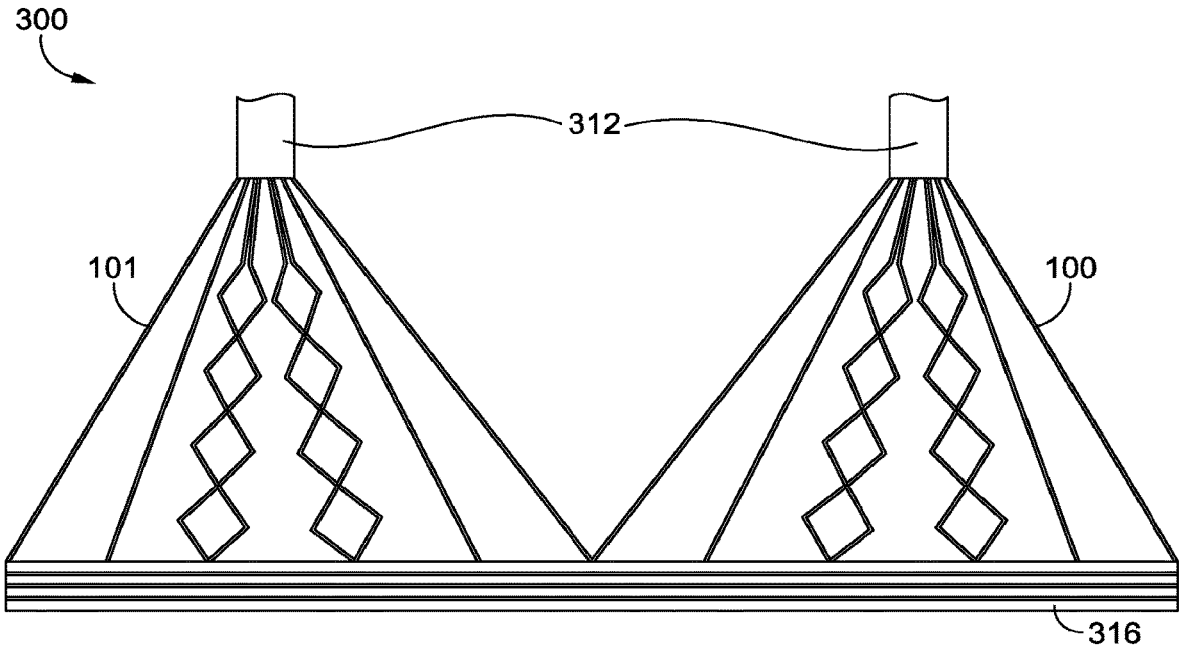
FIG. 3 illustrates a view of a front portion of a support garment in a flat form and in an un-tensioned state in accordance with aspects herein.

FIG. 3 depicts a front portion of a bra 300 in a flat, planar form that includes the breast-covering portion 100 configured for a left breast of a wearer and a breast-covering portion 101 configured for a right breast of the wearer. FIG. 3 further depicts portions of shoulder straps 312 and a portion of an underband 316. In example aspects, the bra 300 may be manufactured as a one-piece unit that includes the shoulder straps 312 and the underband 316. In this aspect, the breast-covering portions 100 and 101 are integrally formed with the shoulder straps 312 and the underband 316. In other example aspects, the breast-covering portions 100 and 101 may be manufactured as a one-piece unit and attached to the shoulder straps 312 and/or the underband 316 by way of stitching, bonding, welding, and the like. In this example, the shoulder straps 312 and/or the underband 316 may be formed of a different material than that used to form the breast-covering portions 100 and 101. For example, the underband 316 may be formed of a material with a degree of stretch to facilitate donning and doffing and to allow for expansion during, for instance, inhalation and movement. In still other example aspects, the breast-covering portion 100 may be manufactured separately from the breast-covering portion 101, and the breast-covering portions 100 and 101 may be joined together using the attaching/affixing technologies described herein.

Figure 4:
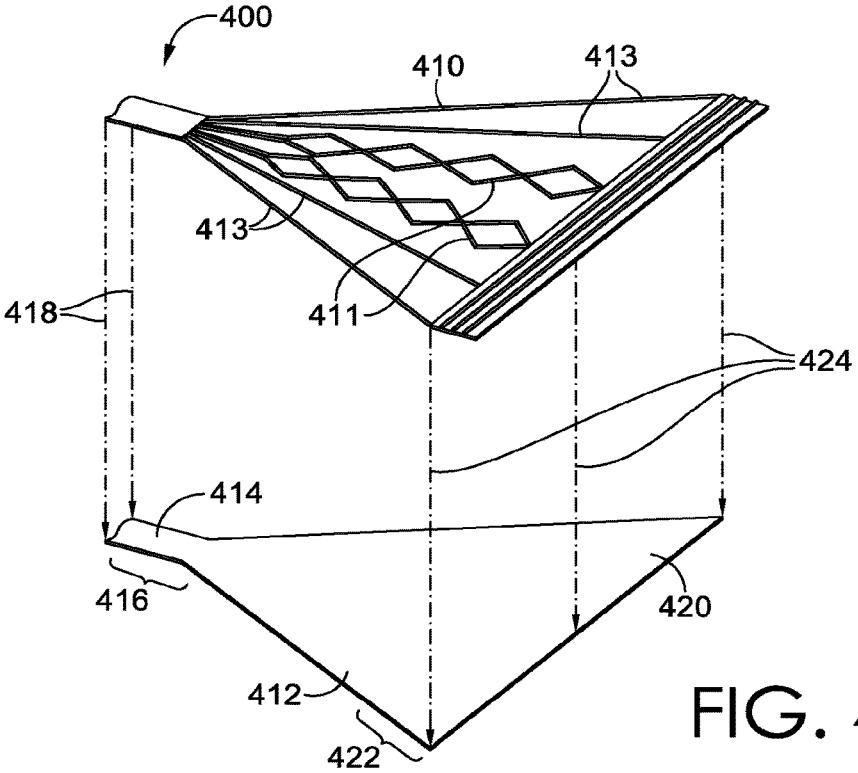
FIG. 4 illustrates an example configuration where the breast-covering portion includes a base layer and a support structure positioned external to the base layer in accordance with aspects herein.

FIG. 4 depicts an exploded view of a breast-covering portion 400 that includes a support structure 410 that is positioned external to a base layer 412. The breast-covering portion 400 is configured for a left breast of a wearer but a breast-covering portion for the right breast would include the same or similar features. The support structure 410 has a configuration similar to that of the support structure 124 of the breast-covering portion 100 of FIG. 1 and includes a first plurality of discrete cable structures 411 and a second plurality of discrete cable structures 413. It is contemplated herein that the support structure 410 may alternatively have a configuration similar to that of the support structure 224 or other similar configurations.

In one example aspect, when the breast-covering portion 400 is incorporated into a bra, the support structure 410 forms an outer-facing surface of the bra and the base layer 412 is configured to be positioned adjacent (i.e., in contact or near contact) with a wearer's breast surface. However, in other example aspects, the support structure 410 may form an inner-facing surface of the bra (i.e., in contact or near contact with a wearer's breast surface) and the base layer 412 may form an outer-facing surface of the bra. In yet other example aspects, the support structure 410 may be positioned between two layers. For example, the support structure 410 may be positioned between base layer 412, which may be positioned adjacent a wearer's breast surface, and an external layer (not shown), which may provide additional comfort and/or structure to the bra as well as provide a different aesthetic.

In example aspects, the base layer 412 may include a continuous textile fabric (e.g., a knit, woven, or nowoven textile) having characteristics such as a soft hand, moisture-wicking properties, and stretch and recovery making it suitable for positioning adjacent to the wearer's breast surface. Aspects herein contemplate that the support structure 410 has a greater resistance to stretch than the base layer 412. By imparting stretch properties to the base layer 412, donning the breast-covering portion 400 is facilitated and wearer comfort may be enhanced during wearer movement. In one example aspect, the base layer 412 may exhibit from about 30% to about 70% more stretch in response to a tensioning force than the support structure 410.

In example aspects, the support structure 410 may be affixed to the base layer 412 at a first location 414 located at an upper aspect 416 of the breast-covering portion 400 as shown by the arrows 418. The support structure 410 may be further affixed to the base layer 412 at a second location 420 located at a lower aspect 422 of the breast-covering portion 400 as shown by the arrows 424. The affixing may be through stitching, bonding, adhesives, melting, and the like. In example aspects, the first plurality of discrete cable structures 411 and the second plurality of discrete cable structures 413 may be unaffixed from (i.e., not affixed to) the base layer 412 between the first location 414 and the second location 420 such that at least the first plurality of discrete cable structures 411 may transition to a linear shape configuration when a breast is positioned within the breast-covering portion 400.

Figure 5:
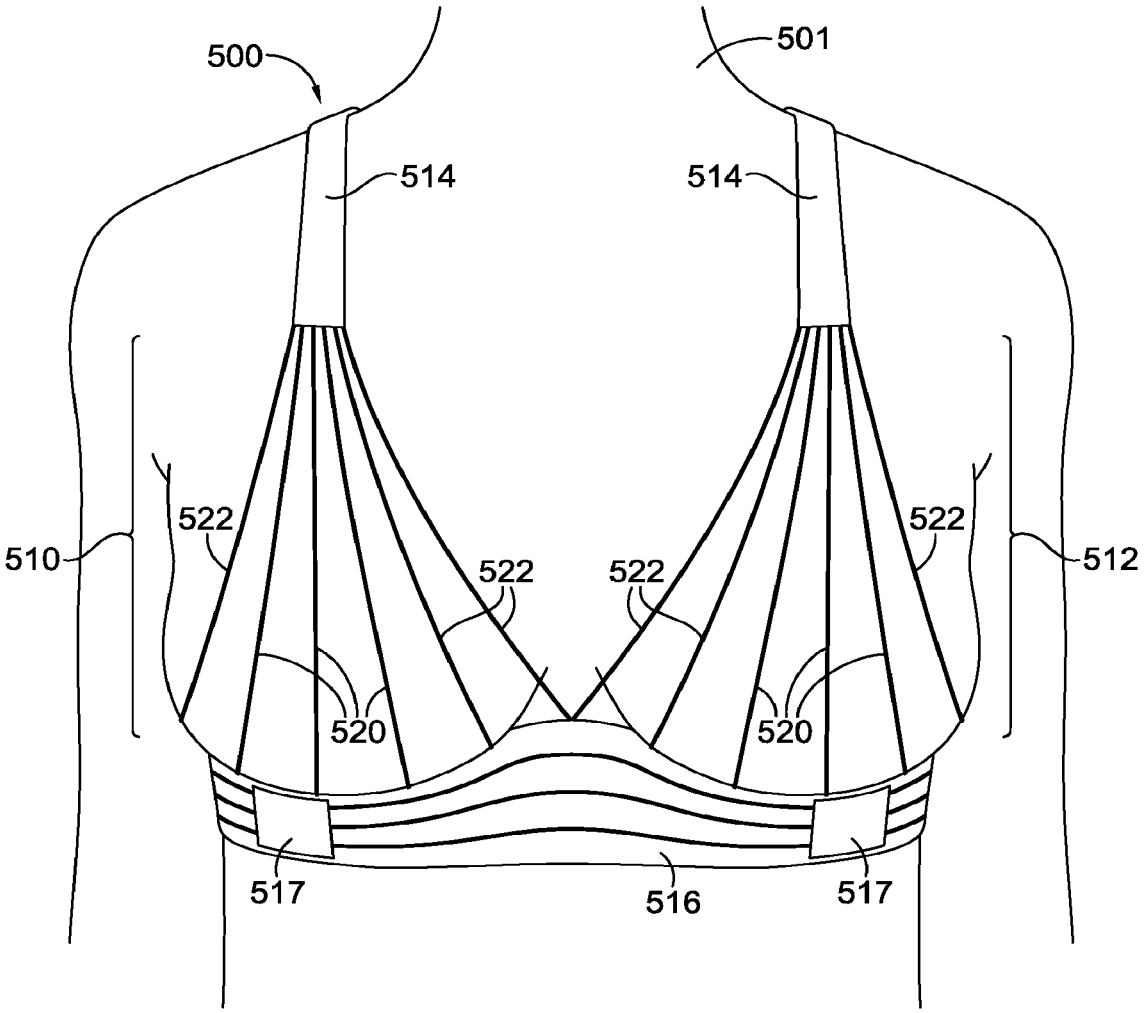
FIG. 5 illustrates a front view of a wearer wearing the support structure of FIG. 1 or 2 in accordance with aspects herein.
Figure 6:
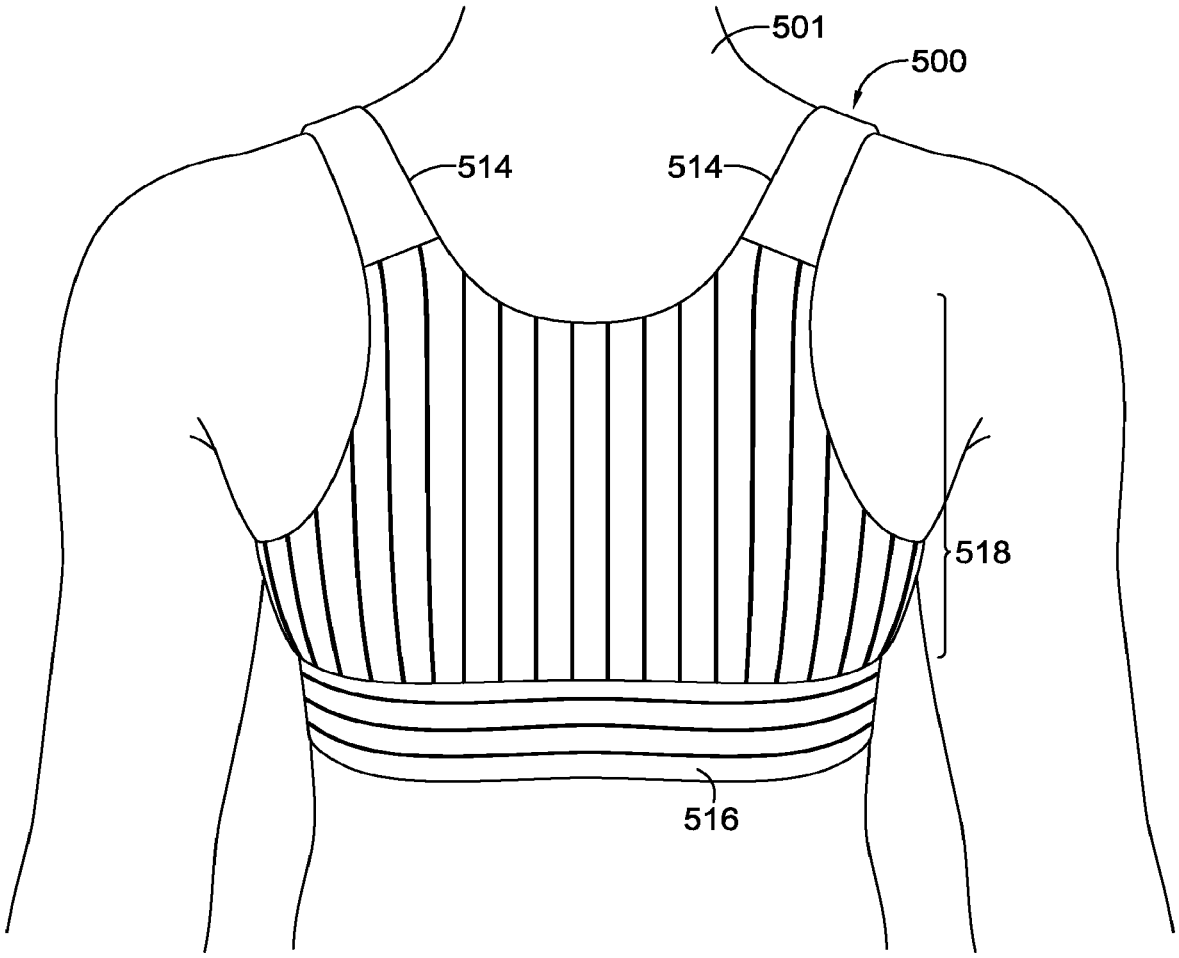
FIG. 6 illustrates a back view of the wearer of FIG. 5 in accordance with aspects herein.

FIGS. 5 and 6 respectively depict a bra 500 being worn by a wearer 501. In example aspects, the bra 500 may include a first breast-covering portion 510, a second breast-covering portion 512, a pair of shoulder straps 514, an underband 516, and a back portion 518 (shown in FIG. 6). The first breast-covering portion 510 is configured to cover a right breast of the wearer 501, the second breast-covering portion 512 is configured to cover a left breast of the wearer 501, and the back portion 518 is configured to cover an upper back torso area of the wearer 501. The shoulder straps 514 are configured to extend over the right and left shoulders of the wearer 501 and connect the first and second breast-covering portions 510 and 512 to the back portion 518. The underband 516 extends from a lower margin of the first and second breast-covering portions 510 and 512, and from a lower margin of the back portion 518 and is configured to encircle the torso area of the wearer 501. The configuration of, for instance, the pair of shoulder straps 514, the back portion 518, and the underband 516 is illustrative, and it is contemplated herein that those portions may have different configurations such as a T-back or racerback configuration. Aspects herein further contemplate that the bra 500 may include strap adjustment mechanisms including sliders as well as closures such that, for example, the underband 516 may include a closure mechanism enabling it to be coupled at, for instance, the back portion 518 of the bra 500. Other types of trim pieces may be incorporated into the bra 500 in accordance with aspects herein.

In one example aspect, the different portions of the bra 500 described above may be integrally formed in a flat, planar form during a single manufacturing process. For example, the different portions of the bra 500 may be formed through a printing process where a material (e.g., TPU) is printed in a pattern corresponding to the different portions of the bra 500. In another example, the different portions of the bra 500 may be cut from a low- or no-stretch material. Once manufactured in the flat, planar form, one or more portions of the bra 500 may be secured to one or more other portions of the bra 500 to complete the construction of the bra 500. In this example aspect, it is contemplated herein that elastic panels may be incorporated into one or more portions of the underband 516 as illustrated by reference numeral 517. Incorporating the elastic panels 517 facilitates donning the bra 500 and also facilitates expansion of the underband during wear especially during exercise. Forming the bra 500 in this manner saves on manufacturing costs and time.

In other example aspects, the first breast-covering portion 510 and the second breast-covering portion 512 may be formed, singly or jointly, in a flat, planar form using the example manufacturing methods described above. Once formed, the first and second breast-covering portions 510 and 512 may be joined to the other portions of the bra 500 (e.g., the pair of shoulder straps 514, the underband 516, and the back portion 518) using affixing technologies described herein. In this example aspect, one or more of the other portions of the bra 500 (e.g., the pair of shoulder straps 514, the underband 516, and/or the back portion 518) may be constructed using different materials other than the low- or no-stretch materials used to form the first and second breast-covering portions 510 and 512. For example, the underband 516 may be formed of a material having stretch and recovery properties to facilitate easier donning and movement during wear.

Aspects herein contemplate that the bra 500 may include a base layer, such as base layer 412. The base layer, if used, may be positioned internal to the first breast-covering portion 510 and the second breast-covering portion 512. The base layer, if used, may also be positioned internal to other portions of the bra 500 such as the pair of shoulder straps 514, the underband 516, and/or the back portion 518. Aspects herein also contemplate that the bra 500 may not include a base layer, as shown, such that the different portions of the bra 500 described above are in contact or near contact with the wearer's skin surface. Aspects herein additionally contemplate that the base layer may be positioned external to the different portions of the bra 500. Further example aspects contemplate that the bra 500 and the base layer may be sold separately where the bra 500 and the base layer are not affixed or attached to each other. In this aspect, a wearer could purchase a base layer having a first color and purchase the bra 500 where the bra 500 may include a second color different from the first color to provide an interesting aesthetic effect when the bra 500 is worn with the base layer.

Each of the first breast-covering portion 510 and the second breast-covering portion 512 include a first plurality of discrete cable structures 520 having a configuration similar to the first plurality of discrete cable structures 126 or 226 and a second plurality of discrete cable structures 522 having a configuration similar to the second plurality of discrete cable structures 132 or 232. The description regarding the first and second pluralities of discrete cable structures 520 and 522 is the same or similar to that of the first and second pluralities of discrete cable structures 126/226 and 132/232 and will not be repeated here.

FIG. 5 depicts the bra 500 in an as-worn configuration where the wearer's breasts are positioned within the first and second breast-covering portions 510 and 512. The displacement created by the wearer's breasts tensions the first plurality of discrete cable structures 520 of the first and second breast-covering portions 510 and 512 and causes them to undergo a reversible increase in length due to the zig-zag and/or wave shapes. For example, in a tensioned state, a force in a z-direction based on the coordinates illustrated in FIG. 1 can contribute to the cable structures 520 undergoing a reversible change in the x-direction and/or y-direction. As such, the displacement created by the wearer's breasts transitions the first plurality of discrete cable structures 520 from the first shape configuration to the second linear shape configuration. Stated differently, the displacement caused by the wearer's breasts pulls the first plurality of discrete cable structures 520 taut, which transitions the zig-zag shapes and/or wave shapes to a linear shape. Because the first plurality of discrete cable structures 520 are formed of a low- or no-stretch material, once taut, the cable structures 520 provide support to at least the central part of the wearer's breasts.

Because there is less breast volume at the lateral and medial sides of the breasts, there is less displacement and tension caused by the wearer's breasts when positioned within the first and second breast-covering portions 510 and 512. Because there is less displacement, there is less need for the second plurality of discrete cable structures 522 to undergo a reversible increase in length. As such, the second plurality of discrete cable structures 522 maintain the second linear shape configuration in both the un-tensioned and the tensioned states.

As described above, each of the first and second pluralities of discrete cable structures 520 and 522 may be modified to provide more or less support and/or to accommodate larger breasts or smaller breasts. For example, the length of the first and second pluralities of discrete cable structures 520 and 522 may be increased to accommodate larger-sized breasts. For the second plurality of discrete cable structures 522 this may be done by increasing the overall length of cable structures 522 since they have a linear configuration. For the first plurality of discrete cable structures 520, this may be done by, for example, increasing the displacement in the positive and negative x-directions of the zig-zags segments and/or by increasing the number of zig-zag segments. To accommodate smaller-sized breasts, the overall length of the cable structures 522 may be decreased and the displacement and/or number of zig-zag segments in the first plurality of discrete cable structures 520 may be reduced. Overall increased support, regardless of breast size may be achieved by increasing the number of discrete cable structures in the first and/or second plurality of discrete cable structures 520 and/or 522.

Figure 7:
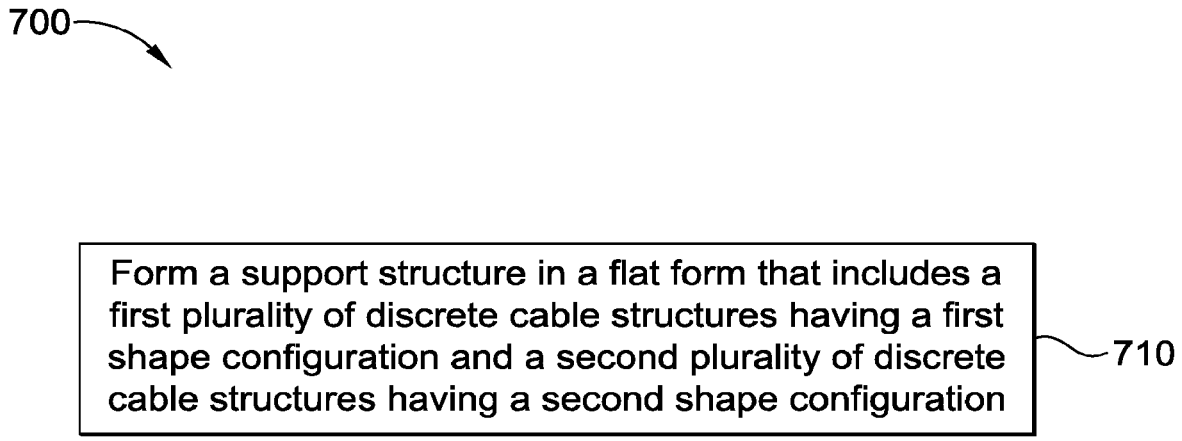
FIG. 7 illustrates a flow diagram of an example method of manufacturing a support structure for a breast-covering portion of a support garment in accordance with aspects herein.

FIG. 7 depicts a flow diagram of an example method of manufacturing a support structure for a breast-covering portion of a support garment such as a bra and is referenced generally by the numeral 700. In example aspects, the support structure may include the support structure 124 of FIG. 1 or the support structure 224 of FIG. 2, and the support garment may include, for example, the bra 500 of FIGS. 5 and 6.

At a step 710, the support structure is formed in a flat, planar form where the support structure includes a first plurality of discrete cable structures such as the first plurality of discrete cable structures 126, 226, or 520 and a second plurality of discrete cable structures such as the second plurality of discrete cable structures 132, 232, or 522. As explained herein, the first plurality of discrete cable structures have the first shape configuration when in the flat, planar form and the second plurality of discrete cable structures have the second shape configuration when in the flat, planar form.

Aspects herein contemplate different ways of forming the support structure. In one example, the support structure may be printed using a polymeric material such as TPU. The TPU material, once cured, exhibits little to no stretch when subjected to tensioning forces. In another example manufacturing method, the support structure may be cut, including die-cutting, from a low- or no-stretch textile material. Example textile materials include, for example, tightly woven textiles that do not include elastic yarns, tightly knit textiles that do not include elastic yarns, nonwoven materials, leather materials, and the like.

In another example manufacturing method, the support structure may be formed by arranging high tenacity, flexible, and low- or no-stretch yarns or threads in a pattern corresponding to the support structure. Example materials include yarns or threads formed of para-aramid fibers. In example aspects, the yarns or threads may be coated or wrapped with a material to improve wearer comfort especially when the support structure is in contact or near contact with the wearer's skin. For example, the yarns or threads formed from para-aramid fibers may be coated with a TPU material or wrapped with polyester yarns, cotton yarns, and the like. With respect to this manufacturing method, it is contemplated herein that the yarns or threads may be embroidered or stitched on to a base layer as described with respect to the support structure 410 shown in FIG. 4.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A breast-covering portion of a support garment, the breast-covering portion comprising:

a first layer, wherein the first layer is a base layer; and a support structure comprising a second layer, wherein the second layer is positioned external to the base layer and including a first plurality of discrete cable structures coupled to the second layer, each discrete cable structure of the first plurality of discrete cable structures having a first shape configuration in an un-tensioned state and a second shape configuration in a tensioned state.

2. The breast-covering portion of claim 1, wherein the support structure is affixed to the base layer at a first location and a second location and unaffixed from the base layer between the first location and the second location.

3. The breast-covering portion of claim 2, wherein the first location is at an upper aspect of the breast-covering portion and the second location is at a lower aspect of the breast-covering portion.

4. The breast-covering portion of claim 2, wherein the first plurality of discrete cable structures extends between the first location and the second location over at least a central region of the breast-covering portion.

5. The breast-covering portion of claim 4, wherein the first plurality of discrete cable structures is not affixed to the base layer between the first location and the second location.

6. The breast-covering portion of claim 1, wherein the support structure has a greater resistance to stretch than the base layer.

7. The breast-covering portion of claim 1, wherein when each discrete cable structure is in the first shape configuration, each discrete cable structure includes a plurality of linear segments alternately extending in a positive x-direction and a negative x-direction.

8. The breast-covering portion of claim 7, wherein when each discrete cable structure is in the second shape configuration, each discrete cable structure includes a single continuous linear segment.

9. A breast-covering portion of a support garment, the breast-covering portion comprising:

a support structure including:

a first plurality of discrete cable structures coupled to the support structure, each discrete cable structure of the first plurality of discrete cable structures having a first shape configuration in an un-tensioned state and a second shape configuration in a tensioned state, the second shape configuration different from the first shape configuration, and a second plurality of discrete cable structures coupled to the support structure, each discrete cable structure of the second plurality of discrete cable structures having the second shape configuration in the un-tensioned state and the tensioned state.

10. The breast-covering portion of the support garment of claim 9, wherein the first plurality of discrete cable structures extends from an upper aspect of the breast-covering portion, over a central region of the breast-covering portion, and to a lower aspect of the breast-covering portion.

11. The breast-covering portion of the support garment of claim 10, wherein the second plurality of discrete cable structures extends from the upper aspect of the breast-covering portion, over a lateral region and a medial region of the breast-covering portion, and to the lower aspect of the breast-covering portion.

12. The breast-covering portion of the support garment of claim 11, wherein the support structure further comprises an underband portion positioned at the lower aspect of the breast-covering portion, and wherein each of the first plurality of discrete cable structures and the second plurality of discrete cable structures extends from the underband portion.

13. The breast-covering portion of the support garment of claim 9, wherein the first shape configuration includes a plurality of linear segments alternately extending in a positive x-direction and a negative x-direction.

14. The breast-covering portion of the support garment of claim 13, wherein the second shape configuration includes a single continuous linear segment.

15. A method of manufacturing a support structure for a breast-covering portion of a support garment, the method comprising:

forming the support structure in a flat, planar form, the support structure including:

a first plurality of discrete cable structures coupled to the support structure, each discrete cable structure of the first plurality of discrete cable structures having a first shape configuration, and a second plurality of discrete cable structures coupled to the support structure, each discrete cable structure of the second plurality of discrete cable structures having a second shape configuration different from the first shape configuration.

16. The method of manufacturing the support structure for the breast-covering portion of the support garment of claim 15, wherein the first shape configuration includes a plurality of linear segments alternately extending in a positive x-direction and a negative x-direction.

17. The method of manufacturing the support structure for the breast-covering portion of the support garment of claim 16, wherein the second shape configuration includes a single continuous linear segment.

18. The method of manufacturing the support structure for the breast-covering portion of the support garment of claim 15, wherein the first plurality of discrete cable structures extends from an upper aspect of the breast-covering portion, over a central region of the breast-covering portion, and to a lower aspect of the breast-covering portion.

19. The method of manufacturing the support structure for the breast-covering portion of the support garment of claim 18, wherein the second plurality of discrete cable structures extends from the upper aspect of the breast-covering portion, over a lateral region and a medial region of the breast-covering portion, and to the lower aspect of the breast-covering portion.

* * * * *